US011603716B2

(12) United States Patent
Prasad et al.

(10) Patent No.: US 11,603,716 B2
(45) Date of Patent: Mar. 14, 2023

(54) HYDRO-PNEUMATIC CYLINDER WITH ANNULUS FLUID BYPASS

(71) Applicant: Dril-Quip, Inc., Houston, TX (US)

(72) Inventors: Neil B. Prasad, Houston, TX (US); Steven M. Hafernik, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/284,238

(22) PCT Filed: Oct. 9, 2019

(86) PCT No.: PCT/US2019/055429

§ 371 (c)(1),
(2) Date: Apr. 9, 2021

(87) PCT Pub. No.: WO2020/076972

PCT Pub. Date: Apr. 16, 2020

(65) Prior Publication Data

US 2021/0355762 A1 Nov. 18, 2021

Related U.S. Application Data

(60) Provisional application No. 62/743,899, filed on Oct. 10, 2018.

(51) Int. Cl.
*E21B 17/01* (2006.01)
*E21B 19/00* (2006.01)

(52) U.S. Cl.
CPC ..... *E21B 19/006* (2013.01); *E21B 17/01* (2013.01)

(58) Field of Classification Search
CPC ..... E21B 17/01; E21B 19/004; E21B 19/006
See application file for complete search history.

(56) References Cited

U.S. PATENT DOCUMENTS 9,181,761 B2 * 11/2015 Hafernik ..... E21B 17/012
9,470,049 B2 * 10/2016 Ellis ..... F16J 15/162
(Continued)

FOREIGN PATENT DOCUMENTS

AU 2012248862 A1 * 9/2013 ..... E21B 19/006
KR 101102809 B1 * 1/2012

OTHER PUBLICATIONS

International Search Report and Written Opinion issued in related PCT Application No. PCT/US2019/055429 dated Jul. 6, 2020, 10 pages.

*Primary Examiner* — Frederick L Lagman
(74) *Attorney, Agent, or Firm* — Baker Botts L.L.P.

(57) ABSTRACT

Systems and methods for pressure communication within a hydro-pneumatic cylinder are provided. The hydro-pneumatic cylinder generally includes a rod, a barrel coaxial to the rod, and a piston assembly disposed within the barrel and connected to the rod. The barrel is hollow to define a chamber, and the piston assembly is axially movable within the chamber to stroke the rod relative to the barrel. The hydro-pneumatic cylinder includes: a flow path formed axially through the rod of the cylinder. This flow path may allow for pressure communication between a low-pressure side of the cylinder and a pressure energized lower pin located at a distal end of the rod. The lower pin may be actuated, via this pressure communication to secure the end of the cylinder to a tension ring on a riser.

21 Claims, 15 Drawing Sheets

(56) References Cited

U.S. PATENT DOCUMENTS

| | | | | |
|---|---|---|---|---|
| 9,540,890 | B1 | 1/2017 | Prasad et al. | |
| 2005/0074296 | A1* | 4/2005 | McCarty ..... | F16F 9/512<br>405/224.4 |
| 2014/0202327 | A1 | 7/2014 | Ellis et al. | |
| 2016/0145951 | A1 | 5/2016 | Ellis et al. | |
| 2016/0145952 | A1 | 5/2016 | Hafernik et al. | |
| 2017/0254159 | A1 | 9/2017 | Kubichek et al. | |
| 2018/0216421 | A1 | 8/2018 | Nunes | |

* cited by examiner

HYDRO-PNEUMATIC CYLINDER WITH ANNULUS FLUID BYPASS

CROSS-REFERENCE TO RELATED APPLICATIONS

The present application is a U.S. National Stage Application of International Application No. PCT/US2019/055429 filed Oct. 9, 2019, which claims priority to U.S. Provisional Application Ser. No. 62/743,899 filed on Oct. 10, 2018 both of which are incorporated herein by reference in their entirety for all purposes.

TECHNICAL FIELD

The present disclosure relates generally to pull-up riser tensioner systems used on offshore floating production and drilling platforms and, more particularly, to a hydro-pneumatic cylinder with annulus fluid bypass for use in a riser tensioner system.

BACKGROUND

Offshore production platforms are often used when performing offshore subterranean operations. Such offshore platforms must typically support a riser that extends from the platform to a subsea well. In some instances, the offshore platform may be fixed to ocean floor, thereby readily providing support for the riser. However, in certain deepwater implementations using floating platforms such as tensioner leg platforms or semi-submersible platforms, supporting the risers may prove challenging. Specifically, a floating platform may move up and down or may be displaced horizontally due to oscillations from waves and currents. It is desirable to maintain a predetermined tension on the riser despite the platform oscillations. Accordingly, tensioners are often utilized to maintain a desired tension on the riser as the platform oscillates.

A typical pull-up riser tensioner system may include multiple tensioner cylinders, which may be hydro-pneumatic cylinders. A lower distal end of the tensioner cylinders may be coupled to a threaded tension ring disposed on a riser. As used herein, the term "riser" may refer to both production and drilling risers. The opposite, top distal end of the tensioner cylinders is coupled to the platform. The tensioner cylinders serve to maintain a substantially constant tension on the riser as the floating platform moves vertically or horizontally due to wind, waves, and other natural events. The tensioner cylinders serve as the connection between the tension ring on the riser and the floating platform.

The tensioner cylinders are usually installed on the platform prior to running the riser. Accordingly, one of the final steps in running the riser is to couple the riser to the tensioner cylinders and transfer the riser weight from the rig to the tensioners. Current approaches for coupling the tensioner cylinders to the tension ring often require rig personnel to manually make the connection. Floating platforms are typically equipped with a lower deck to accommodate rig personnel performing various service on the tensioner cylinders, including making the connections to the tension ring, maintaining the cylinders, and removing/replacing cylinders as needed throughout operation. It is now recognized that a more efficient approach is needed for performing service on pull-up tensioner cylinders, for example, that does not require a lower deck on the floating platform.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
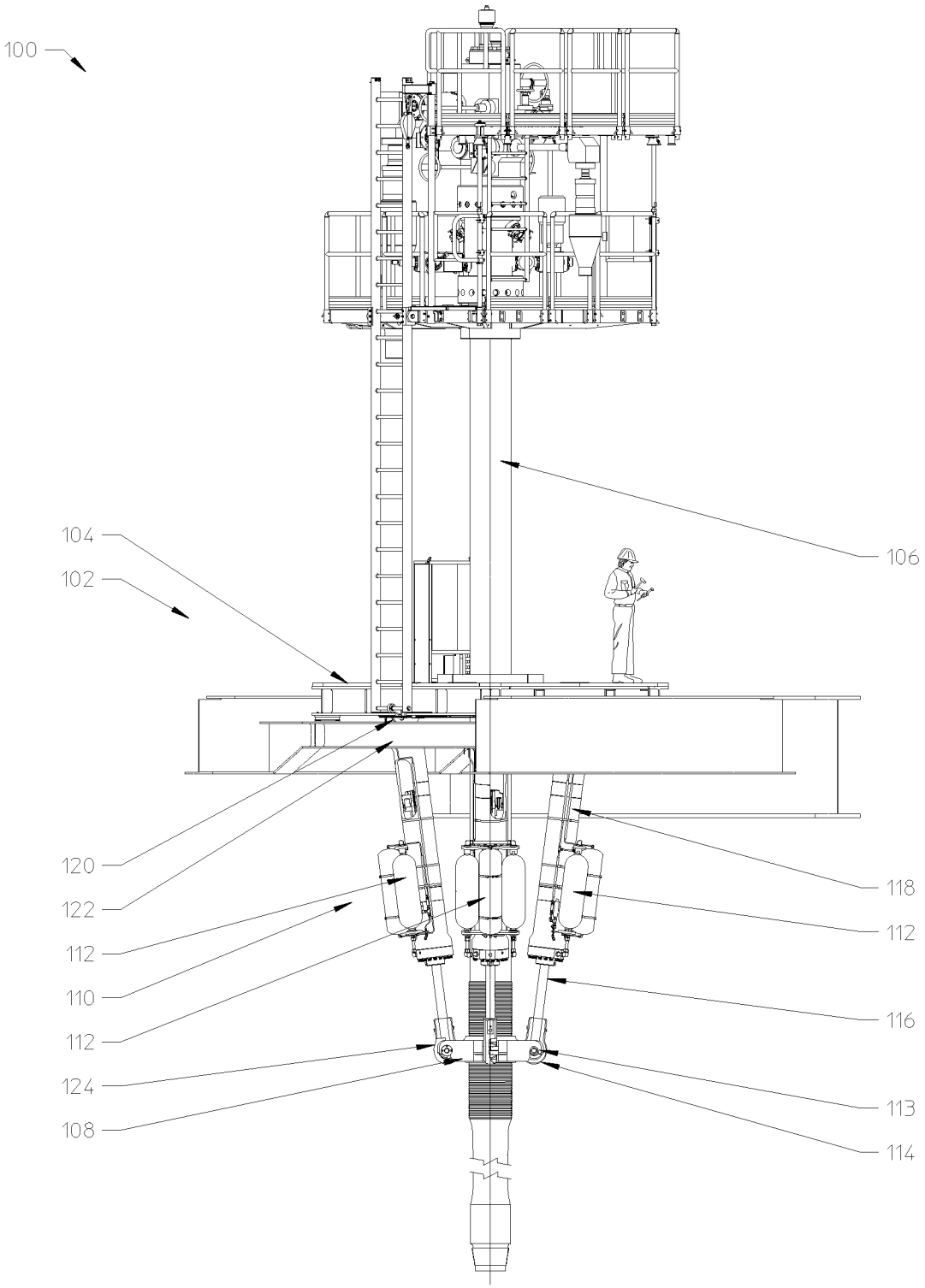
FIG. 1 is a front view of a floating platform with a pull-up tensioner system coupled to a riser, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for pressure communication within a hydro-pneumatic cylinder. The hydro-pneumatic cylinder generally includes a rod, a barrel coaxial to the rod, and a piston assembly disposed within the barrel and connected to the rod. The barrel is hollow to define a fluid chamber, and the piston assembly is axially movable within the fluid chamber to stroke the rod relative to the barrel. The disclosed hydro-pneumatic cylinder includes a flow path formed axially through the rod of the cylinder. This flow path allows for pressure communication between a low-pressure side of the cylinder and a pressure energized lower pin located at a distal end of the rod. The cylinder may include a pilot disposed in the flow path through the rod that selectively enables or prevents pressure communication from the low-pressure side to the lower pin. The lower pin may be actuated via this pressure communication to secure the end of the cylinder to a tension ring on a riser. This actuation of the pin and securing of the cylinder to the tension ring may be accomplished without the help of rig personnel on a lower deck positioned near the tension ring. As such, the disclosed cylinder allows for attachment of the cylinder to a tension ring without any lower deck on the floating platform.

The disclosed systems and methods also allow for the cylinder to be removed from the tension ring without requiring rig personnel on a lower deck of the floating platform. Instead, actuation of the system so that the pneumatic cylinder detaches from the tension ring is initiated and controlled from an upper location on the cylinder.

In some embodiments, the hydro-pneumatic cylinder includes a shuttle disposed in the flow path through the rod, the shuttle being adjacent the pilot. The shuttle is configured to enable a low-pressure side to high-pressure side annulus bypass via the flow path when fluid on the low-pressure side is pressurized above the pressure on the high-pressure side. Specifically, movement of the shuttle in response to pressurized fluid on the low-pressure side of the fluid chamber causes the shuttle to open a third port extending between the rod flow path and an annular chamber in the piston assembly. As pressurized fluid is input to the system from the low-pressure side of the fluid chamber, the fluid passes from the low-pressure side through the flow path and the port to the annular chamber, where it displaces old hydraulic fluid that was previously present in the annular chamber. Therefore, the disclosed systems and methods allow for flushing of hydraulic fluid from the annular chamber of the hydro-pneumatic cylinder from an upper end of the cylinder so that an operator does not need to stand on a lower service deck to service the cylinder.

As such, the disclosed embodiments allow for hydro-pneumatic cylinder installation and maintenance access points to be entirely located at the production deck elevation, where previous existing systems required lower deck access proximate the tension ring. The disclosed embodiments serve to decrease installation and maintenance time, improve efficiency, and reduce customer cost.

Turning now to the drawings, FIG. 1 illustrates an offshore environment 100 in which the disclosed hydro-pneumatic cylinders may be used. The offshore environment 100 generally includes a floating platform 102 with a main production deck 104, a riser 106, a tension ring 108, and a tensioner 110. The tensioner 110 comprises a plurality of hydro-pneumatic cylinders 112. The riser 106 is directed through the platform 102, and the tension ring 108 is coupled to the riser 106. The tension ring 108 may include a retention device 113. The cylinders 112 that make up the tensioner 110 are coupled to the platform 102. Each cylinder 112 may include a retractable rod 116 that may be selectively extended from or retracted into a barrel 118 of the cylinder 112. Bach cylinder 112 may further include a top pin connection 120 at a proximal end 122 thereof proximate to the platform 102 and a bottom pin connection 124 at a distal end 114 thereof proximate to the tension ring 108. The top pin connection 120 may be used to couple the cylinder 112 to the platform 102 with the cylinder 112 rotatable around the top pin connection 120. In certain implementations, the retention device 113 may include a downward facing hook that engages the portions of the bottom pin connection 124 extending from the rod 116 of the cylinder 112.

The hydro-pneumatic cylinders 112 each include features that enable easy installation and maintenance of the tensioner 110 throughout the life of the well. For example, the hydro-pneumatic cylinders 112 are designed to enable secure connection of the distal end 114 of each cylinder 112 to the tension ring 108 without requiring rig personnel standing on a lower deck proximate the tension ring 108. The distal end 114 of the cylinder 112 may be secured to the tension ring 108 via an actuable component located at the distal end 114. Even though the actuable component is located at the distal end 114, the cylinder 112 enables rig personnel to actuate the actuable component from a location on the main production deck 104. In the event that removal of a particular hydro-pneumatic cylinder 112 is required, the cylinder 112 allows rig personnel on the main production deck 104 to initiate a disconnection of the cylinder 112 from the tension ring 108 as well. In addition, the cylinder allows for replacement of high pressure hydraulic fluid within an annular chamber in the cylinder from the production deck 104 while the cylinder remains connected to the platform 102 and to the tension ring 108.

As such, the disclosed hydro-pneumatic cylinders 112 alleviate the need for fabrication of a lower cellar deck on the floating platform for tensioner installation, maintenance, and replacement. Instead, all such operations are performed at the production deck level (104). The hydro-pneumatic cylinders 112 will now be described in greater detail.

Figure 2:
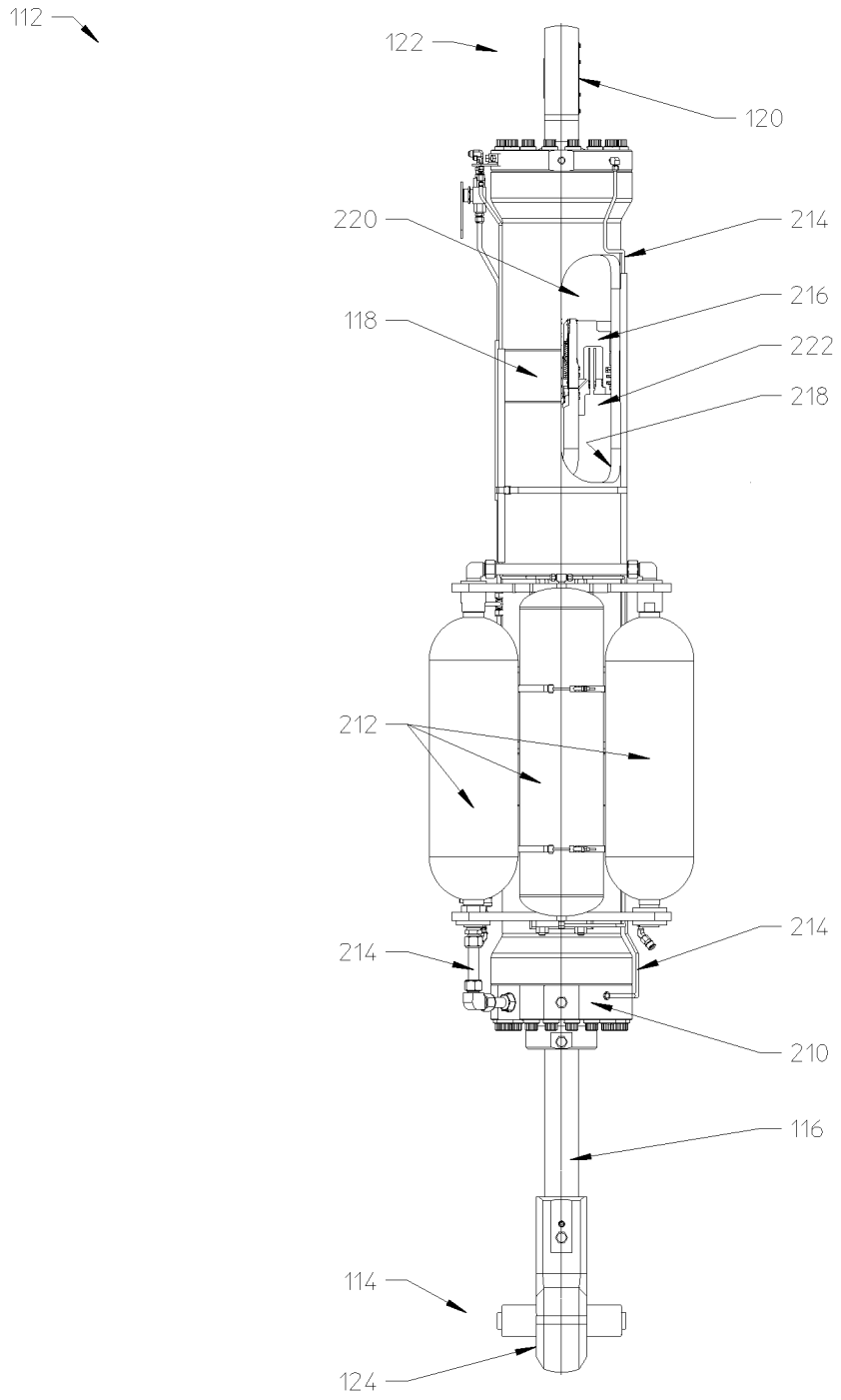
FIG. 2 is a perspective partial cutaway view of a hydro-pneumatic cylinder used in the tensioner system of FIG. 1, in accordance with an embodiment of the present disclosure.

FIG. 2 illustrates a hydro-pneumatic cylinder 112 in accordance with an embodiment of the present disclosure. The cylinder 112 includes the barrel 118 with the rod 116 extending therefrom, the top pin connection 120, which forms one end of the cylinder barrel 118, the bottom pin connection 124 at the distal end 114 of the rod 116, and a cylinder end cap 210, which defines an opposite end of the cylinder barrel 118 from which the rod 116 extends. The cylinder 112 may also include one or more external accumulators 212 used to store additional gas media for the cylinder 112. The external accumulators 212 may include one or more high-pressure accumulators, one or more low-pressure accumulators, or both. Any external high-pressure accumulators are communicatively coupled to a high-pressure side of the cylinder 112, while any external low-pressure accumulators are communicatively coupled to a low-pressure side of the cylinder 112. The high and low-pressure sides of the cylinder 112 are described in greater detail below. It will be understood by one of ordinary skill in the art that the external accumulators 212 are attached to the appropriate side of the cylinder 112 via one or more manifolds 214 that communicate pressure from the relevant external accumulator(s) to the cylinder 112. The gas media within these external accumulators 212 may include nitrogen gas, compressed air, or any other suitable gas media known to one of ordinary skill in the art.

A cutaway portion of the cylinder barrel 118 shows a piston assembly 216 disposed within a fluid chamber 218. The fluid chamber 218 is defined by the cylinder barrel 118. The piston assembly 216 is connected to the cylinder rod 116 and is axially movable within the fluid chamber 218 to stroke the rod 116 relative to the barrel 118.

The fluid chamber 218 (and any connected external accumulators) on one side of the piston assembly 216 contains hydraulic fluid and/or nitrogen gas at a relatively lower pressure, while the fluid chamber 218 (and any connected external accumulators) on the opposite side of the piston assembly 216 contains hydraulic fluid and/or nitrogen gas at a relatively higher pressure. These portions of the fluid chamber 218 on opposite sides of the piston assembly 216 are generally referred to as the low-pressure side 220 and the high-pressure side 222 of the fluid chamber 218. To stroke the rod 116 out further from the barrel 118, additional pressure is applied to the low-pressure side 220 of the cylinder 112.

Figure 3:
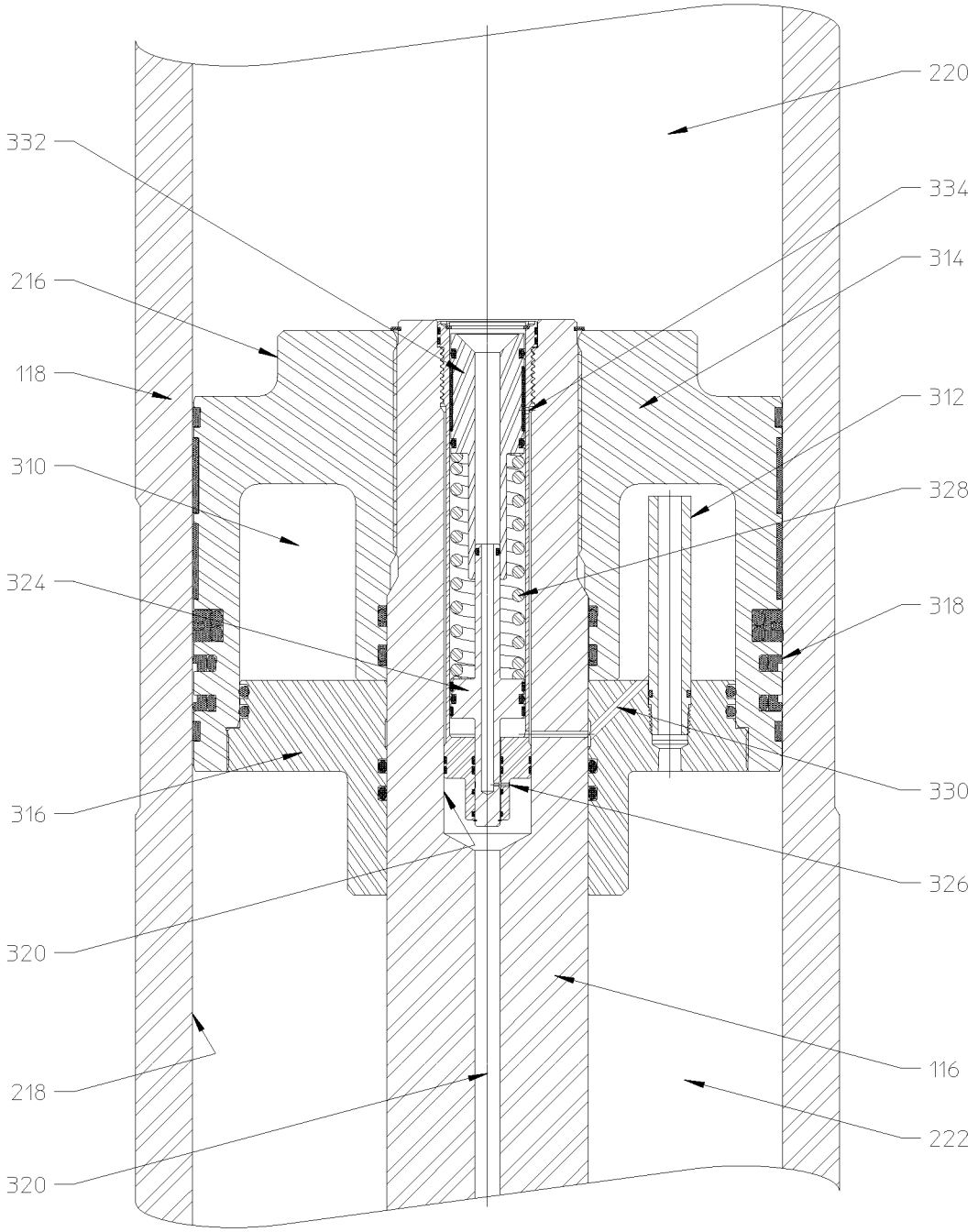
FIG. 3 is a perspective partial cutaway view of a portion of the hydro-pneumatic cylinder of FIG. 2, in accordance with an embodiment of the present disclosure.

FIG. 3 provides a more detailed view of internal components within the barrel 118 of the disclosed cylinder 112. FIG. 3 illustrates the cylinder barrel 118 with the piston assembly 216 disposed therein and coupled to the cylinder rod 116, the high-pressure side 222 of the fluid chamber 218, and the low-pressure side 220 of the fluid chamber 218. The piston assembly 216, as illustrated, may include an annular fluid reservoir (or "annular chamber") 310 formed therein. The annular chamber 310 is in fluid communication with the high-pressure side 222 of the main fluid chamber 218. For example, the piston assembly 216 may include a fluid overflow passage 312 extending from the high-pressure side 222 to an upper portion of the annular chamber 310. This fluid overflow passage 312 may provide pressure communication between the high-pressure side 222 and the annular chamber 310 to maintain hydraulic fluid in the annular chamber 310 at a sufficiently high pressure. When replacement of the hydraulic fluid in the annular chamber 310 is required, the overflow passage 312 enables old hydraulic fluid within the annular chamber 310 to be flushed out of the annular chamber 310 and into the bottom of the cylinder barrel 118 on the high-pressure side 222.

As illustrated, the piston assembly 216 may include a piston body 314 with a hollowed out portion to form the annular chamber 310, a piston end cap 316 to seal the hydraulic fluid within the annular chamber 310, and the overflow passage 312 extending through a portion of the piston end cap 316. However, it should be noted that other arrangements or constructions of the piston assembly 216 may be possible in other embodiments. The piston assembly 216 is securely connected to the cylinder rod 116. Seals (e.g., o-rings) are disposed between a radially exterior surface of the rod 116 and a radially interior surface of the piston assembly 216 to fluidically seal the rod/piston interface.

The cylinder 112 may include a dynamic sealing arrangement 318 located at an interface between a radially exterior wall of the piston assembly 216 and a radially interior wall of the cylinder barrel 118. This dynamic sealing arrangement 318 may fluidically seal this piston/barrel interface while enabling the piston assembly 216 to move axially relative to the barrel 118. Although not shown, the piston assembly 216 may include a small port 319 extending therethrough from the annular chamber 310 to the dynamic sealing arrangement 318. This port provides hydraulic fluid stored in the annular chamber 310 to the dynamic sealing arrangement 318 as the cylinder is stroked during use. As such, the annular chamber 310 enables the piston assembly 216 to hold high-pressure hydraulic fluid used to lubricate the dynamic sealing arrangement 318. This makes the cylinder 112 relatively low profile (low volume).

The cylinder 112 also includes a flow path 320 formed axially through the cylinder rod 116, as illustrated. The flow path 320 may enable communication of pressure from the low-pressure side 220 to an actuable component (not shown) located at the distal end (114 of FIG. 2) of the cylinder 112. The flow path 320 may to be used to communicate pressure from the low-pressure side 220 of the cylinder to actuate the actuable component to secure the distal end 114 of the cylinder 112 to the tension ring (e.g., 108 of FIG. 1). An embodiment of the actuable component and its operation with respect to the tension ring will be described in detail below. In general, the actuable component may be any component designed to secure the distal end 114 of the cylinder 112 to a corresponding retention feature on the tension ring and maintain the connection as long as a positive pressure is applied to the actuable component.

The cylinder 112 may further include a pilot valve (or "pilot") 324 located within the flow path 320 in the rod 116. The pilot 324 regulates pressure communication through the flow path 320. That is, the pilot 324 selectively allows or prevents pressure communication from the flow path 320 on one side of the pilot 324 to the flow path 320 on an opposite side of the pilot 324 depending on an axial position of the pilot 324 within the flow path 320. The pilot 324 is axially movable within the flow path 320 to open or close a port 326 linking the flow path 320 on one side of the pilot 324 to the flow path 320 on the other side of the pilot 324. A biasing mechanism (e.g., spring 328) may bias the pilot 324 in a particular direction (e.g., downward in the present embodiment) to maintain the port 326 in a closed position until an actuating pressure is applied to the pilot 324.

The cylinder 112 includes a port 330 extending from the annular chamber 310 in the piston assembly 216 to the pilot 324. In the illustrated embodiments, this port 330 is formed through the body 314 of the piston assembly 216 and through the rod 116. The port 330 provides pressure communication between the annular chamber 310 and a lower end of the pilot 324, as shown. A biasing mechanism (e.g., spring 328) may bias the pilot 324 in a direction toward this lower end to maintain the port 326 through the rod 116 closed until an actuating pressure is applied to the pilot 324. When pressure is increased on the high-pressure side 222 of the cylinder 112, the increased pressure is communicated through the overflow passage 312, the annular chamber 310, and the port 330 to the lower side of the pilot 324. The increased pressure forces the pilot 324 upward to open the port 326 between the flow path 320 on one side of the pilot 324 and the flow path 320 on the other side of the pilot 324.

In addition to the pilot 324, the cylinder 112 may include a shuttle valve (or "shuttle") 332 located within the flow path 320 in the rod 116. The shuttle 332 regulates fluid flow through a bypass between the low-pressure side 220 and the annular chamber 310. That is, the shuttle 332 selectively allows or prevents pressure and fluid communication from a portion of the flow path 320 that is open to the low-pressure side 220 to the annular chamber 310, depending on an axial position of the shuttle 332 within the flow path 320. The shuttle 332 is axially movable within the flow path 320 to open or close a port 334 linking the low-pressure side of the flow path 320 to the annular chamber 310. As illustrated herein, the port 334 may generally link the flow path 320 directly to the port 330, which provides the ultimate connection to the annular chamber 310. However, in other embodiments the port 334 may be entirely separate from the port 330.

A biasing mechanism (e.g., spring 328) may bias the shuttle 332 in a particular direction (e.g., upward in the present embodiment) to maintain the port 334 through the rod 116 closed until an actuating pressure is applied to the shuttle 332. As illustrated, a single spring 328 (or other biasing mechanism) may be utilized to bias both the pilot 324 and the shuttle 332 in desired directions within the rod flow path 320. In other embodiments, however, a different biasing mechanism may be utilized for each of the pilot 324 and the shuttle 332.

Actuation of the shuttle 332 to open the port 334 is accomplished by increasing pressure on the low-pressure side 220 so that it exceeds the pressure of nitrogen gas on the high-pressure side 222. This actuation may be performed when the hydraulic fluid within the annular chamber 310 is to be replaced. In such instances, new hydraulic fluid is input to the low-pressure side 220 at a pressure higher than the high-pressure side 222. This forces the shuttle 332 downward to expose the port 334, which enables the new hydraulic fluid to flow into the annular chamber 310, displacing the old hydraulic fluid. These and other operations will be described in greater detail below.

Previous cylinder designs with an annular chamber in the piston assembly generally included an access port located on the lower cylinder rod extension to communicate fluid to the annular chamber. This required intermittent (e.g., annual) access at a lower cellar deck level to perform hydraulic fluid service on the annular chamber. In the disclosed embodiments, the shuttle 332 enables high pressure fluid in the annular chamber 310 to be refilled from the top side of the cylinder 112 (as opposed to a lower distal end 114), by circulating fresh fluid from the low-pressure side 220 of the cylinder 112. Thus, the disclosed cylinder 112 allows for hydraulic fluid maintenance without a lower deck on the floating platform.

In FIG. 3, the cylinder 112 is in a "nominal" cylinder configuration. In this configuration, the internal components of the cylinder 112 are those of the cylinder 112 once it is connected to the tension ring 108 and being used to provide tension to the connected riser as needed in response to movement of the floating platform. In this nominal position, the pilot 324 is in an actuated position such that the port 326 is open. The shuttle 332, meanwhile, is in an un-actuated position such that the port 334 is closed. The pilot 324 and shuttle 332 are maintained in these states via pressure from the high-pressure side 222 communicated to the pilot 324 via the port 330 and via the spring 328, respectively.

Figure 4:
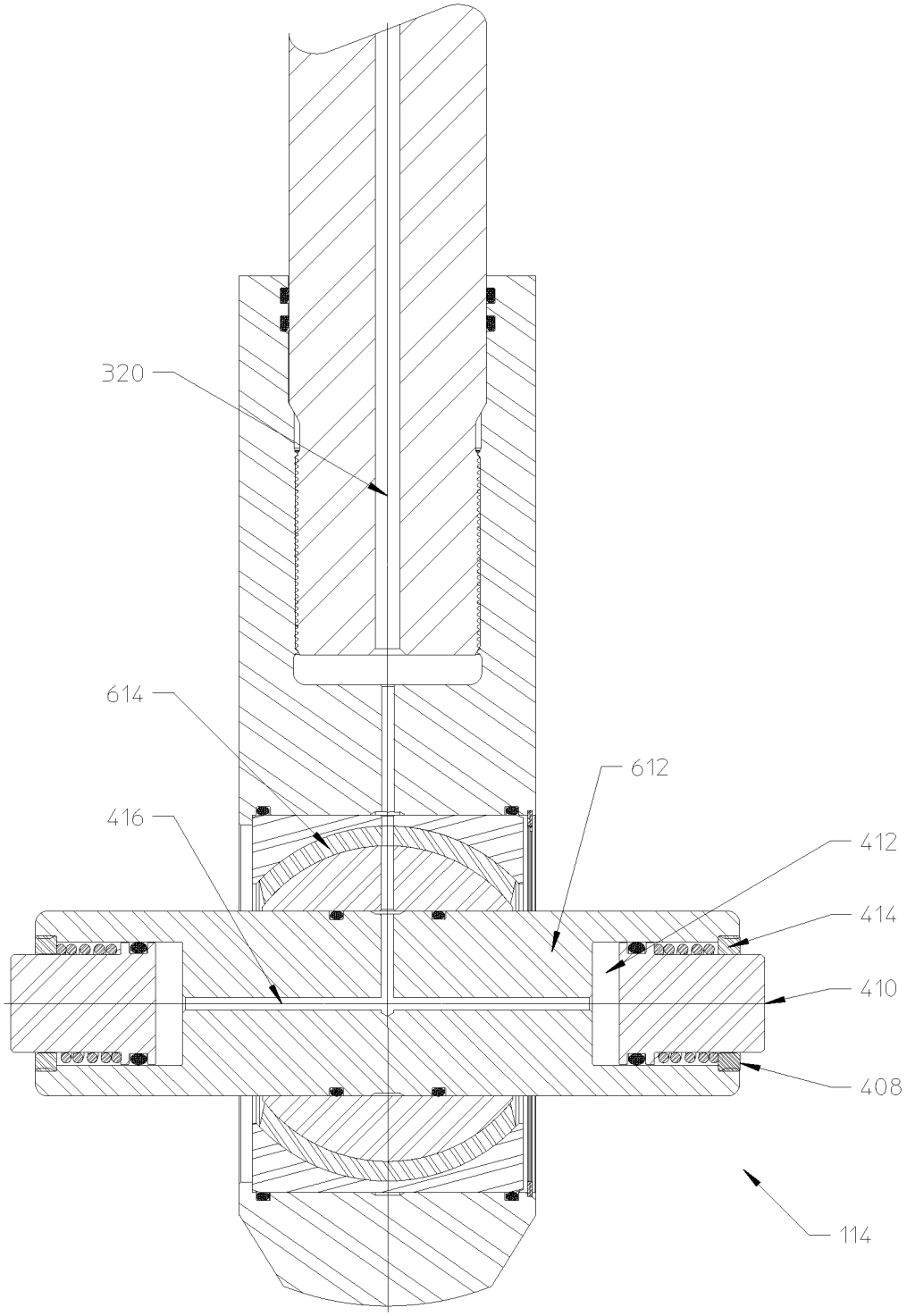
FIG. 4 is a perspective partial cutaway view of a distal end of the hydro-pneumatic cylinder of FIG. 2 in a nominal cylinder condition, in accordance with an embodiment of the present disclosure.

FIG. 4 illustrates the distal end 114 of the hydro-pneumatic cylinder 112, which includes the aforementioned actuable component 408, when the cylinder 112 is in the nominal configuration. As illustrated, the flow path 320 through the rod 116 extends all the way through the rod down to the distal end 114. Pressure is communicated through the flow path 320 at desired times to actuate the actuable component 408.

The actuable component 408 in this embodiment is a connector pin 410. The connector pin 410 is at least partially disposed within a fluid chamber 412 at the distal end 114 of the cylinder 112. The pin 410 generally functions as a piston. The pin 410 is movable relative to the chamber 412 in response to pressure changes within the chamber 412. A ring 414 keeps the pin 410 from being pushed entirely out of the chamber 412, and a spring biases the pin 410 in the direction of the flow path 320. There are fluidic seals at the interface of the pin 410 and the internal walls of the chamber 412. The chamber 412 is fluidly connected to the flow path 320 via a radial port 416, so that pressure communication through the flow path 320 will enter the chamber 412 and press outwardly on the pin 410.

In response to increased pressure in the chamber 412, the pin 410 will be moved so that it extends outward from the body of the distal end 14 having the chamber 412. In this extended position, the pin 410 may secure the distal end 114 of the cylinder 112 to a retention device on a tension ring. In FIG. 4, the pin 410 is shown in this extended position.

Figure 5:
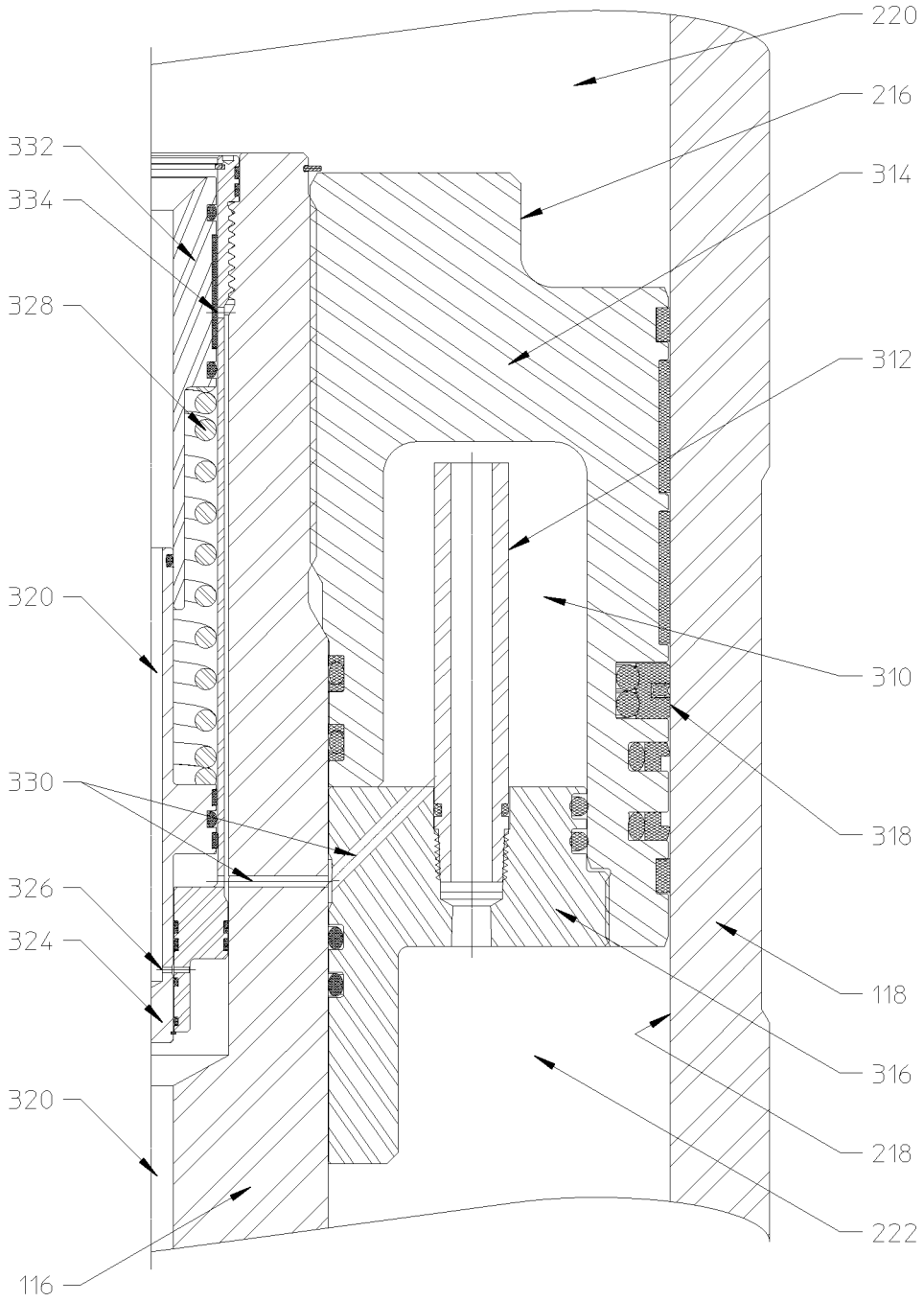
FIG. 5 is a cutaway view of a portion of the hydro-pneumatic cylinder of FIG. 2 in a nominal cylinder condition where the cylinder is being attached to a tension ring, in accordance with an embodiment of the present disclosure.

FIG. 5 provides another illustration of the disclosed cylinder 112 in the nominal position. In FIG. 5, the cylinder 112 is illustrated such that the ports 330, 326, and 334 as well as the overflow passage 312 are present in the same cross section. It should be understood that not all of these flow paths need to be present within the same cross section. For example, as illustrated in FIG. 3, the port 330 and overflow passage 312 may be located at different positions about the circumference of a longitudinal axis of the cylinder 112. Additionally, the ports 326 and 334, in some embodiments, may be located at different positions from the port 330 about the circumference of the longitudinal axis of the cylinder 112.

Figure 6:
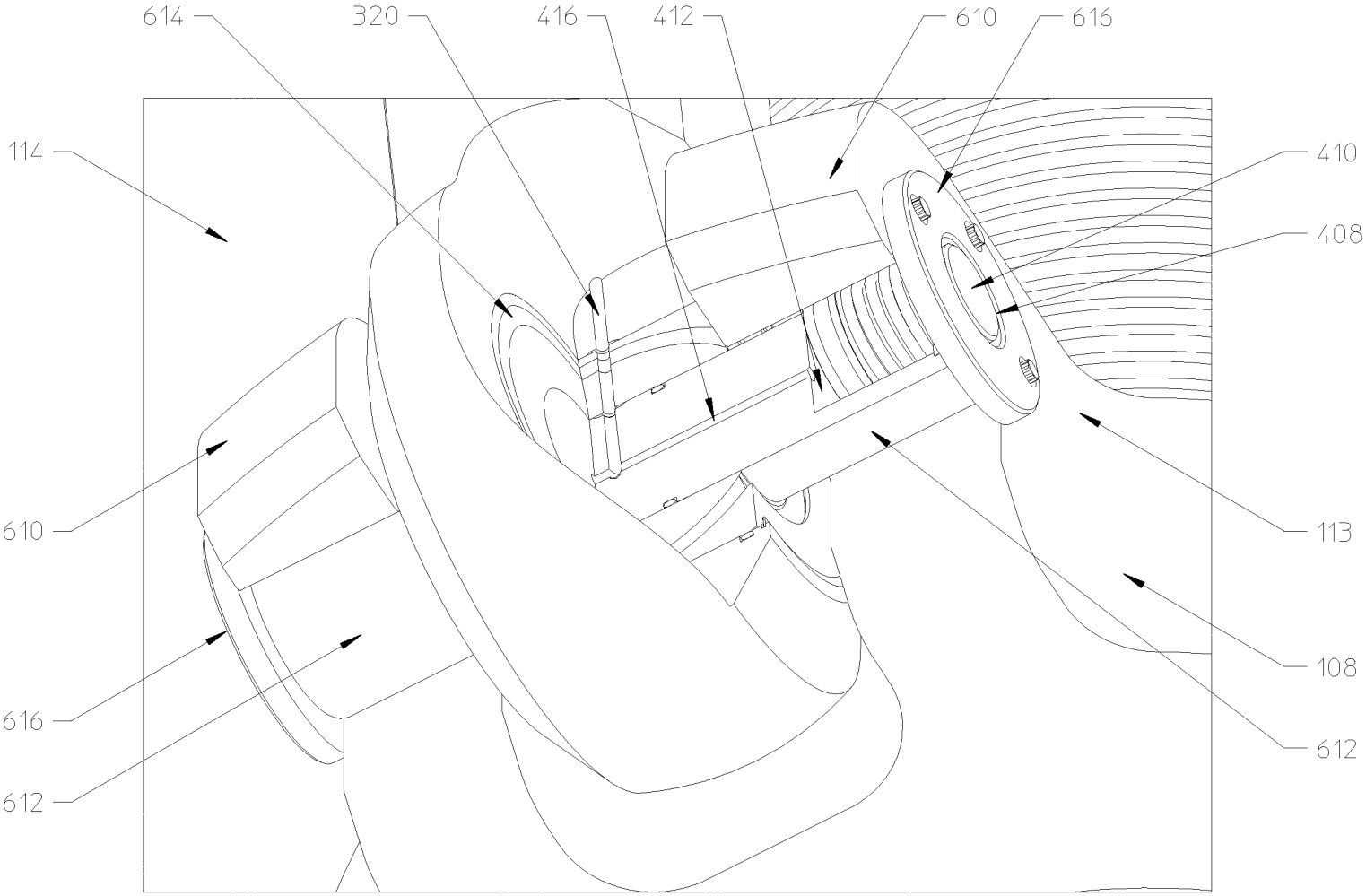
FIG. 6 is a perspective partial cutaway view of the distal end of the hydro-pneumatic cylinder of FIG. 2 in an energized position where it is attached to a tension ring, in accordance with an embodiment of the present disclosure.

FIG. 6 shows the distal end 114 of the cylinder 112 connected to the tension ring 108. In the illustrated embodiment, the distal end 114 of the cylinder 112 is secured to the tension ring 108 via the actuable component (pin 410) interacting with the retention device 113 on the tension ring 108. The retention device 113 may include a U-shaped bracket into which the distal end 114 of the cylinder 112 is received during installation of the cylinder 112. During installation, the cylinder 112 (already connected to the floating platform) is swung and/or stroked into a position within the bracket. The bracket may include two hook-shaped arms 610 facing downward. Protrusions 612 on each side of the distal end 114 are received into these hook-shaped arms 610 during installation. The distal end 114 may also include an elastomeric spherical bearing 614 to accommodate angular offset and to self-centralize the distal end 114 within the hook-shaped arms 610 during installation. The hook-shaped arm 610 may include an annular plate 616 on one side, and this annular plate 616 is designed to receive the extended pin 410. During installation, the distal end 114 is swung into place and received between the hook-shaped arms 610 of the bracket, and once in place the pin 410 is actuated into engagement with the annular plate 616.

Although shown as just one pin 410 that is extendable into a space formed by the annular plate 616 on one side of the bracket, it should be noted that a second pin 410 may be present within the distal end 114 of the cylinder 112 as well. The second pin 410 may be on an opposite side of the bottom pin connection 124 from the illustrated pin 410 and may be similarly connected to the flow path 320 so that pressure through the flow path 320 actuates both pins 410 at the same time. Both hook-shaped arms 610 of the bracket may include annular plates 616 into which the two pins 410 of the cylinder 112 are actuated via pressure through the flow path 320.

The pin 410 as illustrated is in an energized position. The piston portion of the pin 410 is energized via low-pressure securement to the tension ring 108. That is, the distal end 114 of the cylinder 112 receives pressure from the low-pressure side 220 of the cylinder 112 to energize the pin 410.

The distal end 114 cannot be swung into place and received between the hook-shaped arms 610 of the bracket while the pin 410 is extended from the distal end 114. The pin 410 is only extended into position within the annular plate(s) 616 after the distal end 114 has been received into the hook-shaped arms 610. Once the distal end 114 is received into the hook-shaped arms 610, pressure within the chamber 412 behind the pin 410 will push the pin 410 outward into the annular plate 616 to secure the distal end 114 to the tension ring 108.

As discussed above, the cylinder 112 uses the pilot 324 to allow or block low pressure flow down the rod 116 to actuate the pin 410 depending on whether the cylinder's high-pressure side 222 is energized. That way, actuation of the pin 410 can be accomplished entirely from the top side of the tensioner, not from the bottom of the rod 116 adjacent the tension ring 108. As such, the operation of actuating the pin 410 to secure the cylinder to the tensioner ring 108 can be accomplished without rig personnel on a lower deck.

Having now described the general layout of components within the disclosed cylinder 112, a description of various modes of operation of the cylinder 112 will now be provided. FIGS. 7, 8, 9, 10 illustrate the cylinder 112 being operated to attach the cylinder 112 to the tension ring 108. The illustrations of FIGS. 7, 8, 9, 10 show both the internal components within the cylinder barrel 118 as well as the components located within the distal end 114 of the cylinder 112 at different times during the process of attaching the cylinder 112 to the tension ring 108. In general, to attach the cylinder 112 to the tension ring 108, first the high-pressure side 222 is energized, and then the low-pressure side 220 communicates low pressure through the rod 116 to actuate the pin 410 at the distal end 114. This process is generally used during installation of the cylinder 112.

Figure 7:
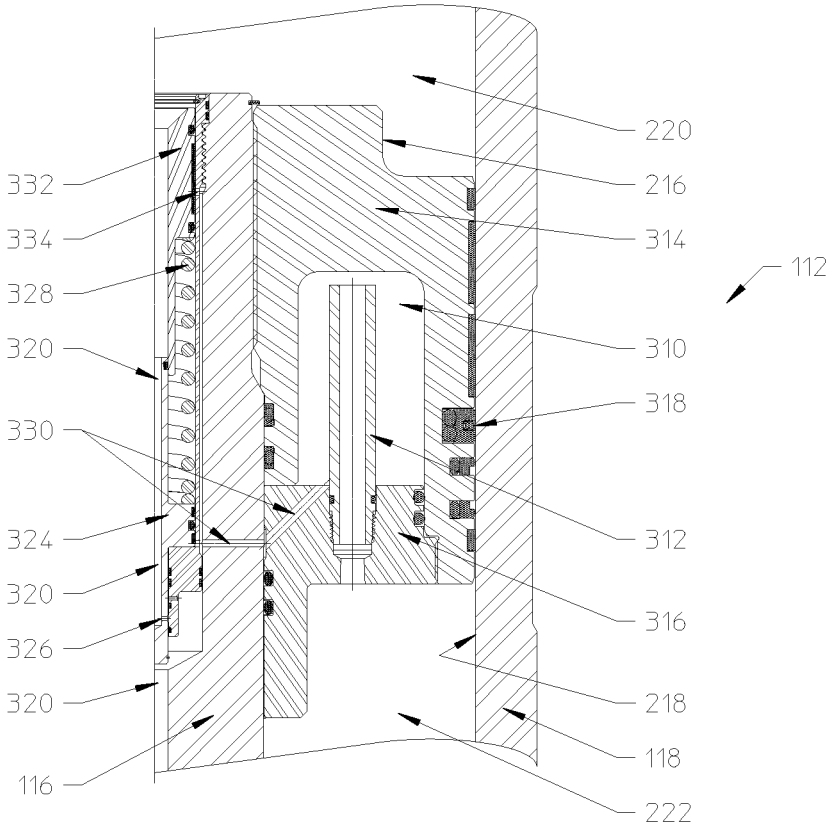
FIGS. 7, 8, 9, 10 are cutaway views of portions of the hydro-pneumatic cylinder of FIG. 2 during a process of the hydro-pneumatic cylinder connecting to a tension ring, in accordance with an embodiment of the present disclosure.
Figure 7:
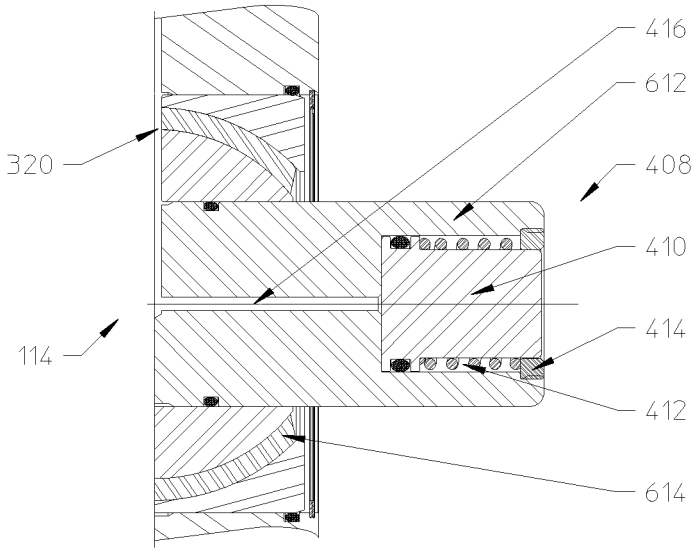

FIG. 7 shows the cylinder 112 in a free hanging position. That is, the internal components of the cylinder 112 are those of a free hanging cylinder 112 before actuation of a lower connection pin and without recirculating fluid through the annular chamber 310. In this free hanging position, both the pilot 324 and the shuttle 332 are in un-actuated positions such that the port 326 and the port 334 are closed. The pilot 324 and shuttle 332 are maintained in these un-actuated positions via their biasing mechanism(s). For example, in the illustrated embodiment, the pilot 324 and shuttle 332 are kept in position via the spring 328.

Figure 8:
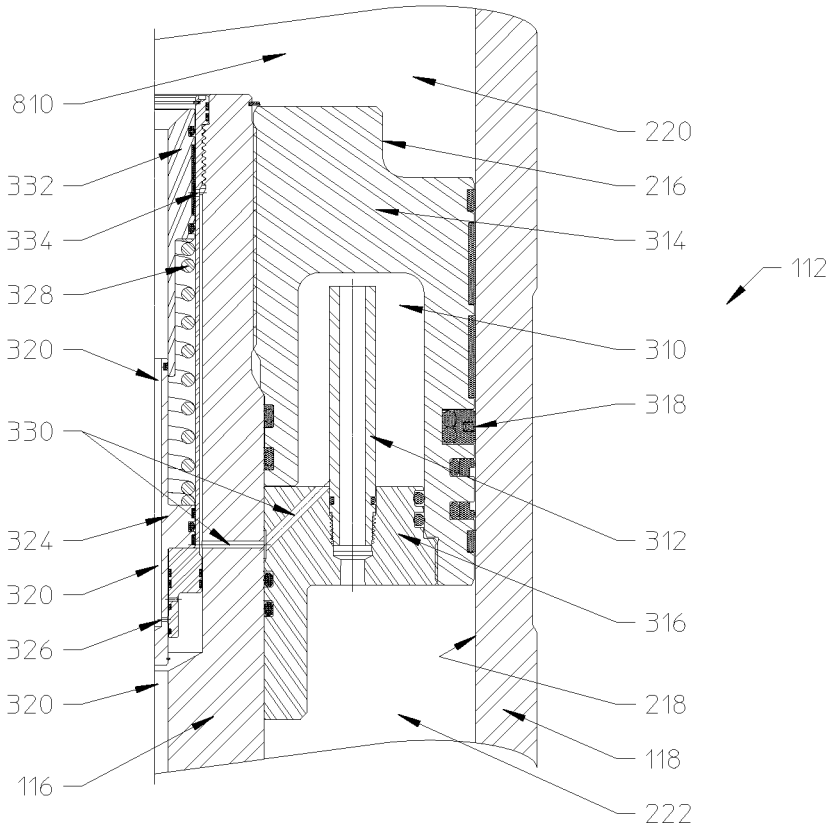
Figure 8:
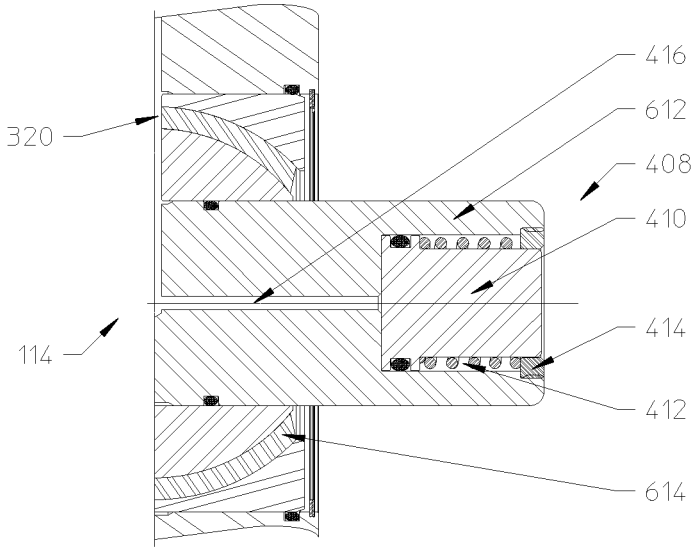

At this point, the cylinder 112 may be stroked out by applying pressure to the low-pressure side 220 without engaging the lower pin 410. FIG. 8 shows the cylinder 112 with the low-pressure side being pressured up (810) to stroke the cylinder 112 such that the rod 116 is extended outward from the barrel 118 to a position beyond where it is needed to connect to the retention device on the tension ring. At this point, a separate positioning mechanism (not shown) may be utilized to tilt the cylinder 112 to a desired position relative to the floating platform such that the cylinder 112 can be received into the retention device of the tension ring. The high-pressure side 222 may then be activated to pull the extended rod 116 upward and into engagement with the retention device, as shown in FIG. 9.

Figure 9:
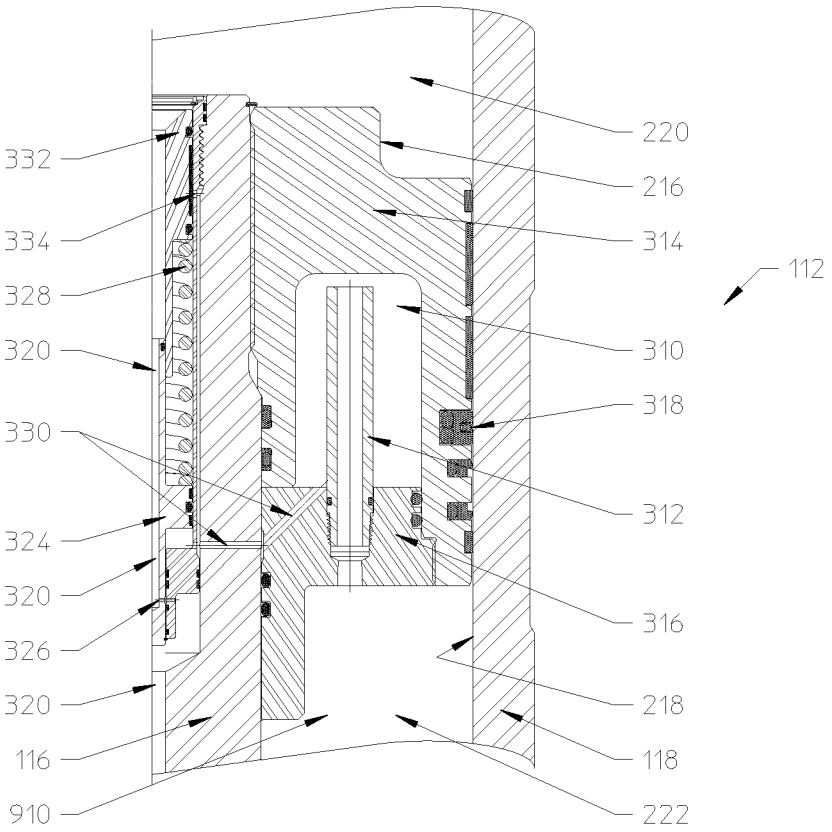
Figure 9:
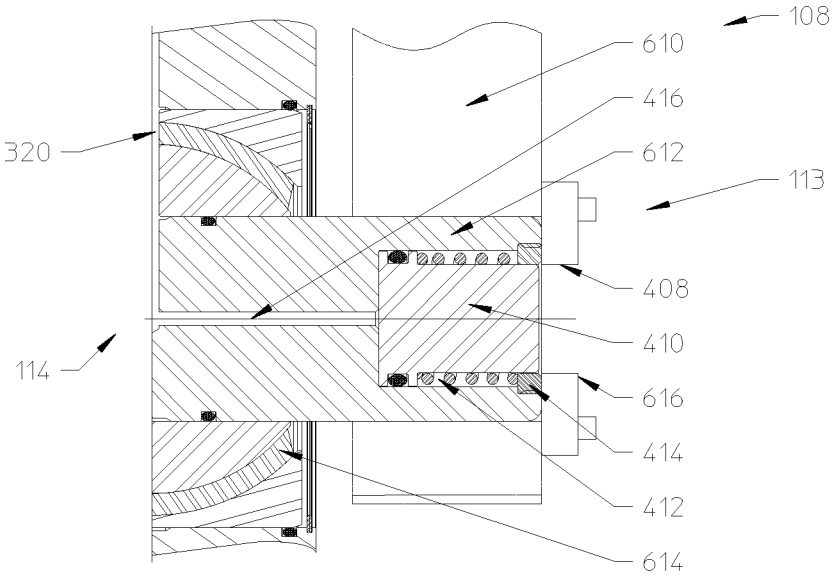
Figure 10:
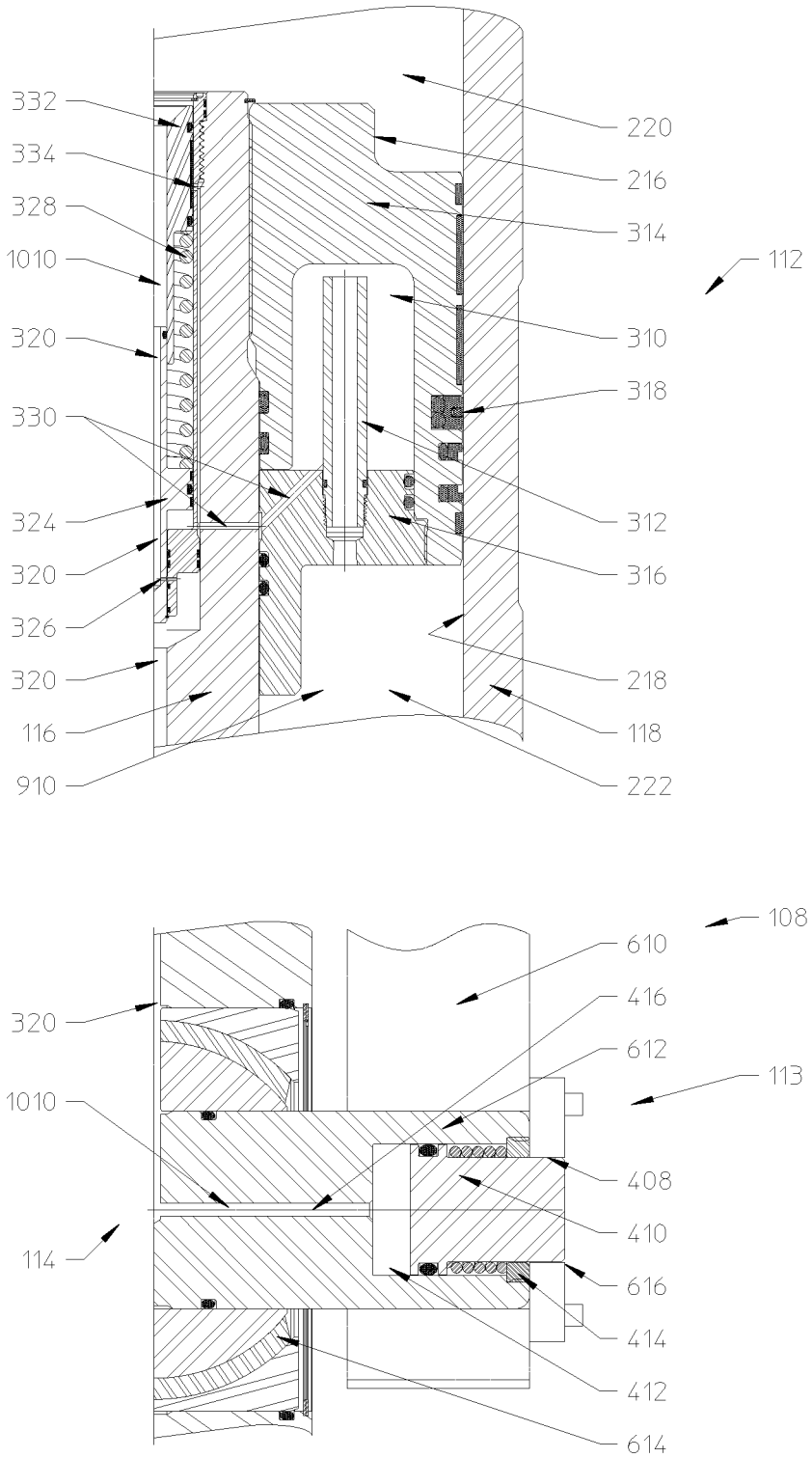

FIG. 9 shows the cylinder 112 with the high-pressure side 222 being energized via high pressure nitrogen gas (910). In addition to providing a pulling force to position the distal end 114 of the cylinder 112 within the retention device, the high pressure travels through the overflow passage 312 into the annular chamber 310 and through port 330 to the pilot 324. This forces the pilot 324 upward and compresses the spring 328. The pilot 324 shifting upward opens the port 326, thereby allowing pressure communication (1010) through the flow path 320 in the rod 116, as shown in FIG. 10. This provides pressure communication (1010) from the low-pressure side 220 to the chamber 412 to actuate the pin 410 into the extended position at the distal end 114 of the cylinder 112. As illustrated in FIG. 10, the pin 410 is energized into engagement with the annular plate 616 of the tension ring 108, thereby securing the distal end 114 of the cylinder 112 to the tension ring 108. The cylinder 112 is now in the nominal configuration. As long as the increased pressure (910) is maintained on the high-pressure side 222, the pin 410 will remain in position to keep the cylinder 112 securely attached to the tension ring 108 in this nominal position.

Figure 11:
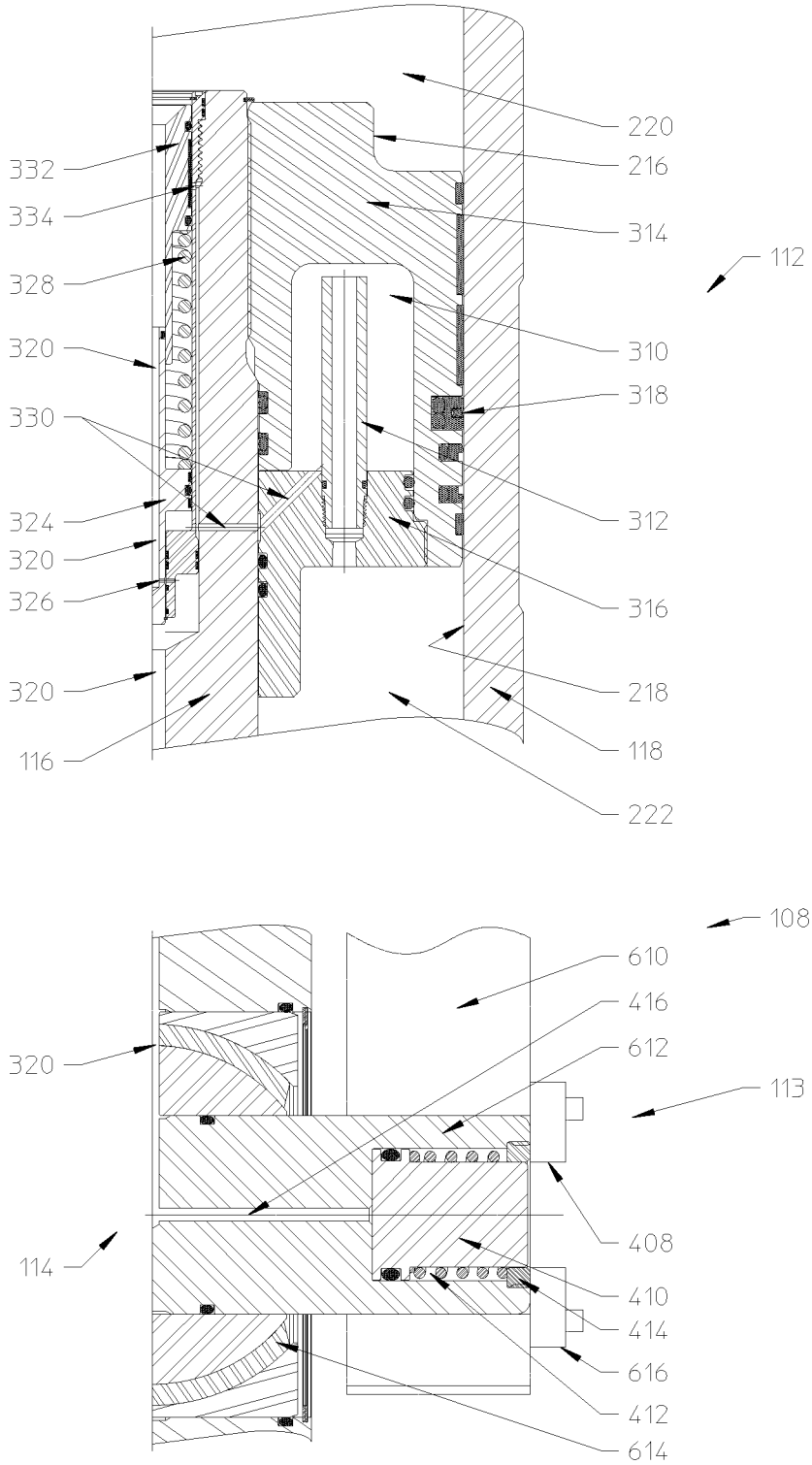
FIGS. 11, 12, 13 are cutaway views of portions of the hydro-pneumatic cylinder of FIG. 2 during a process of the hydro-pneumatic cylinder disconnecting from a tension ring, in accordance with an embodiment of the present disclosure.
Figure 12:
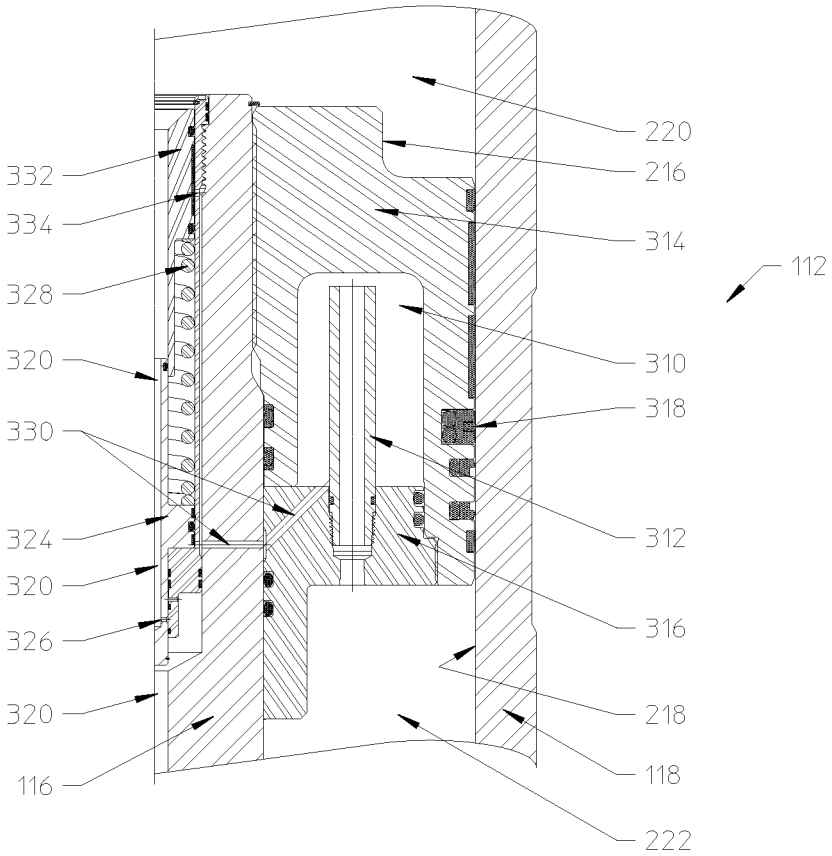
Figure 12:
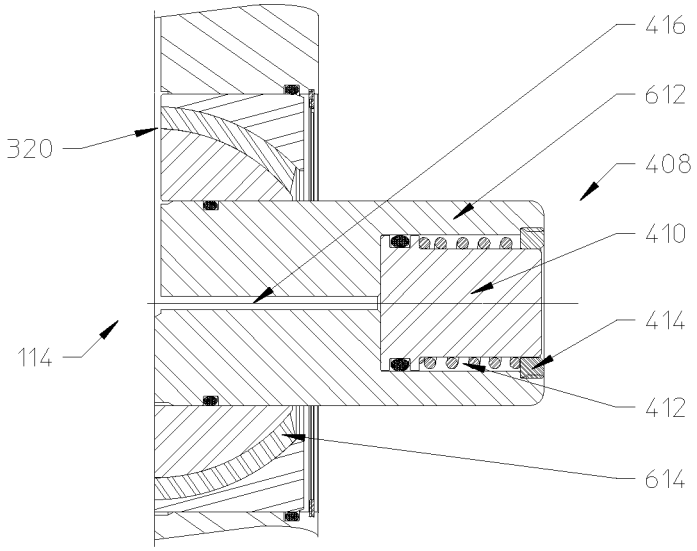
Figure 13:
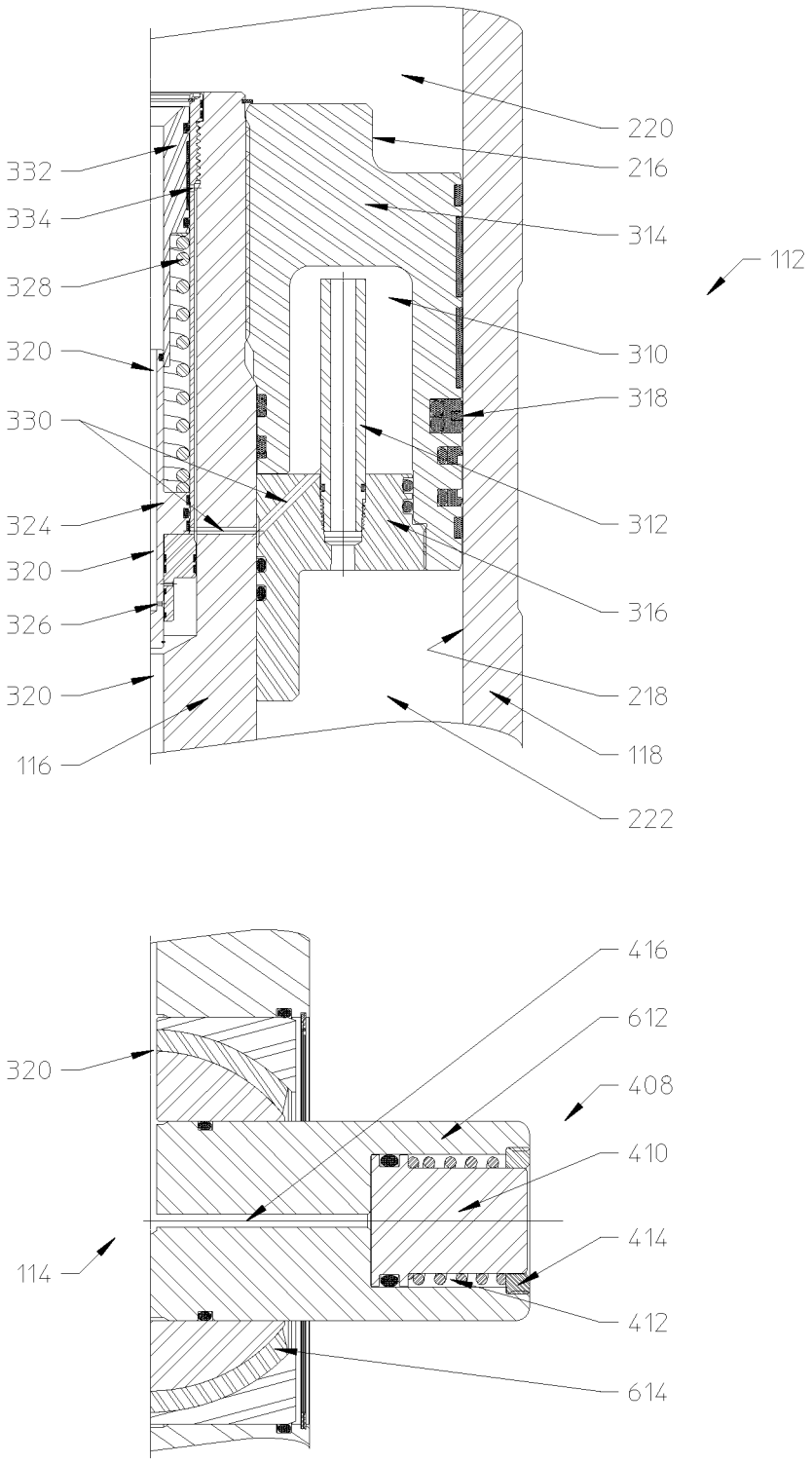

FIGS. 11, 12, 13 illustrate the cylinder 112 being operated to remove the cylinder 112 from the tension ring 108. The illustrations of FIGS. 11, 12, 13 show both the internal components within the cylinder barrel 118 as well as the components located within the distal end 114 of the cylinder 112 at different times during the process of detaching the cylinder 112 from the tension ring 108. In general, to detach the cylinder 112 from the tension ring 108, first the low-pressure side 220 is bled off, and then the high-pressure side 222 is bled off so that low pressure can be applied to the low-pressure side 220 again without actuating the pin 410. This process is generally used during disconnection and replacement of the cylinder 112.

The cylinder 112 begins in the nominal position discussed above. FIG. 11 shows the cylinder 112 with pressure being bled off from the low-pressure side 220. The reduction of pressure communicated through the flow path 320 to the lower pin 410 causes the pin 410 to be disengaged from the retention device 113 of the tension ring 108. That is, the pin 410 is no longer engaged with the annular plate(s) 616 of the tension ring 108. FIG. 12 shows the high pressure from the high-pressure side 222 being bled off, thereby reducing the pressure sent to the pilot 324 via the port 326. As a result, the pilot 324 is forced downward by the spring 328 to close the port 330, thereby blocking pressure flow through the flow path 320 between the low-pressure side 220 and the pin 410 at the distal end 114. Bleeding off the high-pressure side also releases tension from the cylinder 112 to detach the cylinder 112 from the tension ring 108. The low-pressure side 220 may then be pressured up, as shown in FIG. 13, to stroke out the cylinder rod 116 without engaging the lower pin 410.

Figure 14:
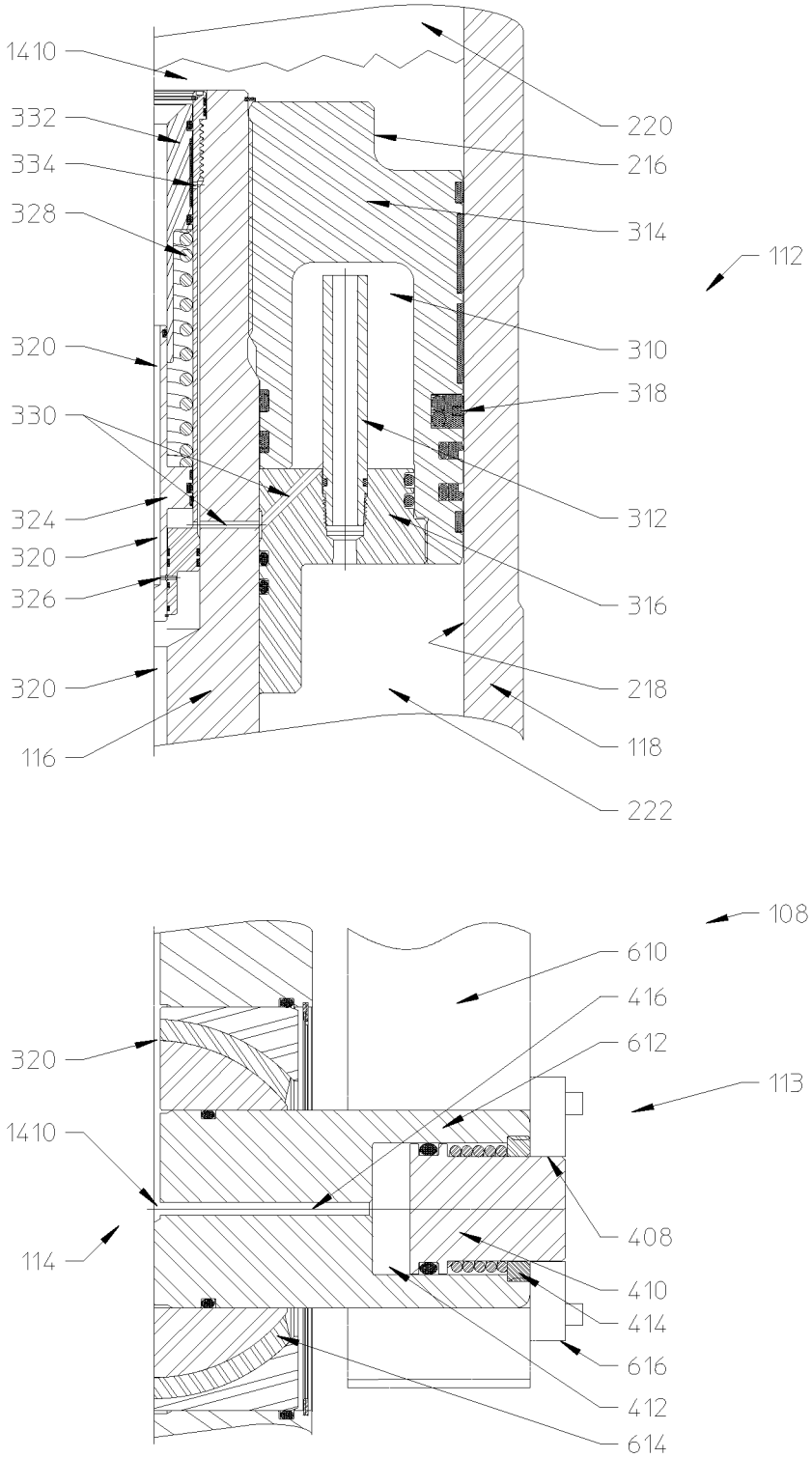
FIGS. 14 and 15 are cutaway views of portions of the hydro-pneumatic cylinder of FIG. 2 during a process of performing a fluid flush through the hydro-pneumatic cylinder, in accordance with an embodiment of the present disclosure.
Figure 15:
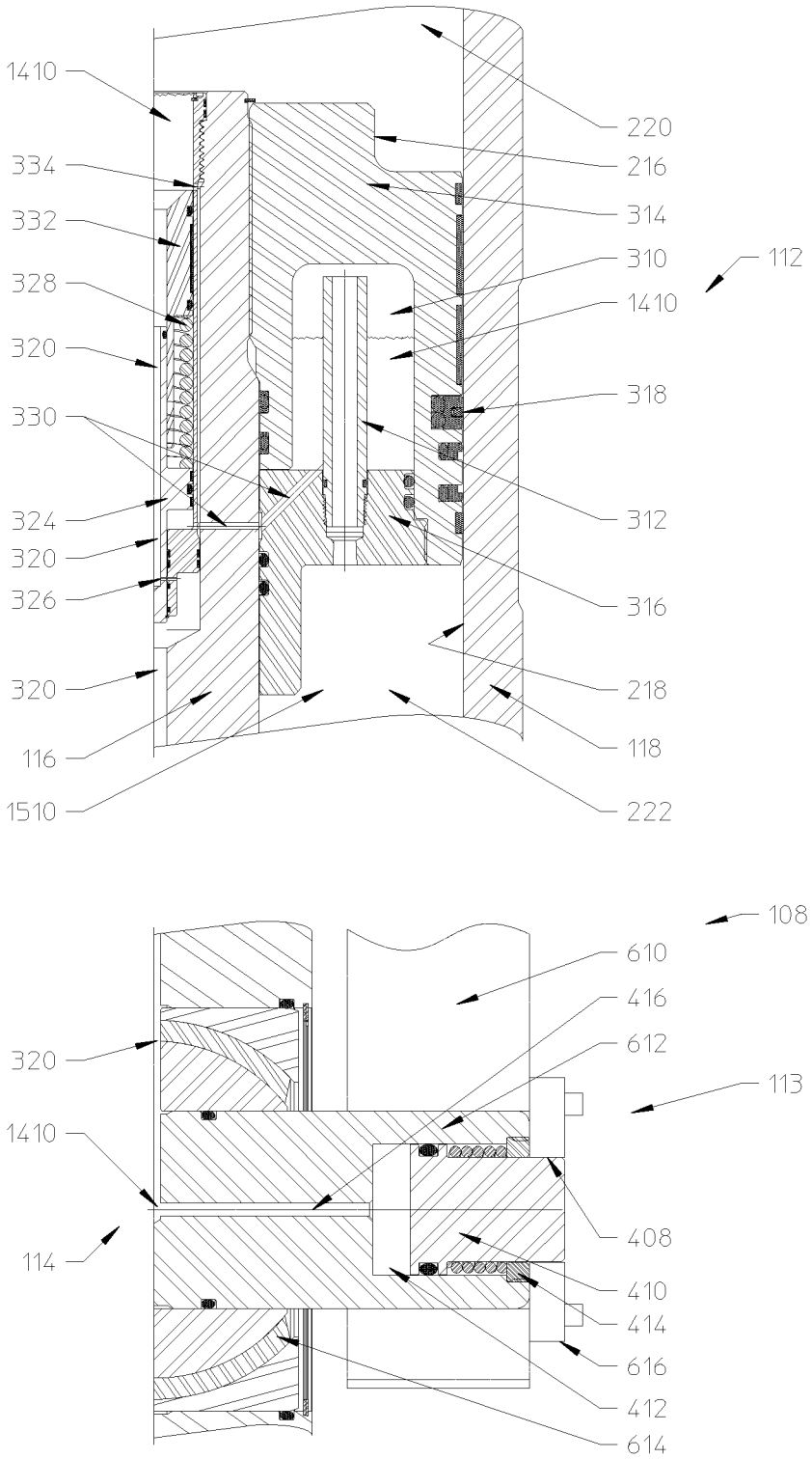

FIGS. 14 and 15 illustrate the cylinder 112 being operated to perform a high pressure fluid flush/circulation of fluid into the annular chamber 310 of the piston assembly 216. This may be performed at regular intervals (e.g., annually) as necessary to maintain the proper lubrication of the dynamic sealing arrangement 318 of the cylinder 112. The illustrations of FIGS. 14 and 15 show both the internal components within the cylinder barrel 118 as well as the components located within the distal end 114 of the cylinder 112 at different times during the process of flushing the high pressure fluid within the annular chamber 310. As illustrated, this process may be entirely performed while the cylinder 112 is securely attached to the tension ring 108 via the pin 410 at the distal end 114. In general, to perform the fluid flush, first the high-pressure side 222 is energized, and then the low-pressure side 220 is brought up to a pressure that is higher than the high-pressure side 222 to flush dirty hydraulic fluid from the annular chamber 310.

The cylinder 112 begins in the nominal position discussed above. In the nominal position, the low-pressure side 220 may be held at a first relatively low pressure (e.g., approximately 30 psi), while the high-pressure side 222 may be held at a second higher pressure (e.g., approximately 500 psi). FIG. 14 shows fresh hydraulic fluid (1410) being added to the cylinder 112 on the low-pressure side 220. The pressure on the low-pressure side 220 is then increased to match the pressure of the high-pressure side 222. As the low-pressure side 220 and high-pressure side 222 are pressure equalized, the shuttle 332 moves downward against the restoring force of the spring 328. This movement of the shuttle 332 is shown in FIG. 15. The movement of the shuttle 332 exposes the port 334 to the annulus bypass, thereby allowing communication between the low-pressure side 220 and the high-pressure side 222 via the port 326, annular chamber 310, and overflow passage 312. The spring 328 is sized to provide a range of acceptable fluid service pressures (e.g., 550-650 psi on the low-pressure side 220). The pressure on the low-pressure side 220 may be increased (e.g., to approximately 650 psi) above that of the high-pressure side 222 and then held until the hydraulic fluid (1410) from the low-pressure side 220 is forced into the high pressure fluid cavity. Old hydraulic fluid (1510) from the annular chamber 310 is forced out through the overflow passage 312 and into a waste fluid circuit at the bottom of the cylinder barrel 118.

All three functions described above with reference to FIGS. 7, 8, 9, 10 (attachment to tension ring 108), FIGS. 11, 12, 13 (removal from tension ring 108), and FIGS. 14 and 15 (fluid flush of hydraulic fluid) may be performed on the cylinder 112 without needing external access to a lower portion (i.e., the distal end 114) of the cylinder 112. As such, the disclosed cylinder 112 enables hands free attachment and detachment of the cylinder 112 relative to the tension ring 108 and fluid maintenance within the internal fluid reservoir 310 without the need for a lower cellar deck on the floating platform. Fluid access for control of each of these processes is available entirely from the main production deck on the floating platform. As such, the cylinder 112 provides an improvement over previously existing tensioner cylinders that were more difficult to install, remove, and service because of the limited access via a lower deck. The cylinder 112 can also be used with a less costly floating platform having only a main production deck.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a cylinder comprising a rod, a barrel coaxial to the rod, and a piston assembly disposed within the barrel and connected to the rod, wherein the barrel is hollow to define a chamber, and wherein the piston assembly is axially movable within the chamber to stroke the rod relative to the barrel;

an actuable component separate from the barrel and the piston, the actuable component located at a distal end of the rod extending away from the barrel; and a flow path formed axially through the rod, wherein the flow path is in fluid communication with the chamber on a first side of the piston assembly, and wherein the flow path extends to the actuable component located at the distal end of the rod.

2. The system of claim 1, further comprising an annular volume located within the piston assembly and in fluid communication with the chamber on a second side of the piston assembly opposite the first side.

3. The system of claim 2, further comprising:

a pilot disposed within the flow path, wherein movement of the pilot selectively opens or closes a first port between the flow path on one side of the pilot and the flow path on an opposite side of the pilot; and a second port extending from the annular volume to the pilot.

4. The system of claim 3, further comprising:

a shuttle disposed within the flow path, wherein movement of the shuttle selectively opens or closes a third port between the annular volume and the chamber on the first side of the piston assembly.

5. The system of claim 1, wherein the actuable component is a tension ring connector configured to secure the distal end of the rod to a tension ring on a riser.

6. The system of claim 5, wherein the tension ring connector comprises a fluid chamber communicatively coupled to the flow path and a pin partially held within the fluid chamber and configured to extend from the fluid chamber and interface with a tension ring upon actuation of the tension ring connector.

7. A system, comprising:

a cylinder comprising a rod, a barrel coaxial to the rod, and a piston assembly disposed within the barrel and connected to the rod, wherein the barrel is hollow to define a chamber, and wherein the piston assembly is axially movable within the chamber to stroke the rod relative to the barrel;

a flow path formed axially through the rod, wherein the flow path is in fluid communication with the chamber on a first side of the piston assembly;

an annular volume located within the piston assembly and in fluid communication with the chamber on a second side of the piston assembly opposite the first side; and a pilot disposed within the flow path, wherein movement of the pilot selectively opens or closes a first port between the flow path on one side of the pilot and the flow path on an opposite side of the pilot.

8. The system of claim 7, further comprising an actuable component located at a distal end of the rod extending away from the barrel, wherein the flow path extends to the actuable component.

9. The system of claim 8, wherein the actuable component is a tension ring connector configured to secure the distal end of the rod to a tension ring on a riser.

10. The system of claim 9, wherein the tension ring connector comprises a fluid chamber communicatively coupled to the flow path and a pin partially held within the fluid chamber and configured to extend from the fluid chamber and interface with a tension ring upon actuation of the tension ring connector.

11. The system of claim 7, further comprising:

a second port extending from the annular volume to the pilot; and a shuttle disposed within the flow path, wherein movement of the shuttle selectively opens or closes a third port between the annular volume and the chamber on the first side of the piston assembly.

12. The system of claim 11, further comprising a spring disposed within the flow path, wherein the spring is disposed between the pilot on one side and the shuttle on an opposite side.

13. A method, comprising:

connecting a proximal end of a cylinder to a floating platform, the cylinder comprising a rod, a barrel coaxial to the rod, and a piston assembly disposed within the barrel and connected to the rod, wherein the barrel is hollow to define a chamber, and wherein the rod has an axial flow path formed therethrough;

positioning a distal end of the rod extending from the barrel within a retention device of a tension ring coupled to a riser;

actuating a pilot disposed within the flow path to open a first port between the flow path on one side of the pilot and the flow path on an opposite side of the pilot; and actuating a tension ring connector disposed at the distal end of the rod via pressurization from the flow path to secure the distal end of the rod to the retention device.

14. The method of claim 13, further comprising increasing pressure within the chamber on a first side of the piston assembly to move the rod such that the distal end of the rod is positioned in the retention device.

15. The method of claim 14, wherein increasing the pressure within the chamber on the first side of the piston assembly also actuates the pilot disposed within the flow path to open the first port.

16. The method of claim 14, wherein actuating the tension ring connector disposed at the distal end of the rod comprises increasing pressure within the chamber on a second side of the piston assembly opposite the first side, wherein the flow path is in fluid communication with the second side of the chamber.

17. The method of claim 13, wherein an annular volume is located within the piston assembly, wherein the annular volume is in fluid communication with a first side of the piston assembly, and wherein actuating the pilot comprises communicating pressurized fluid from the annular volume to a second port leading from the annular volume to the pilot in response to pressurization within the chamber on the first side of the piston assembly.

18. The method of claim 13, further comprising:

releasing the pin from the retention device by bleeding pressure from the flow path while the first port is open;

removing the distal end of the rod from the retention device;

releasing the pilot to close the first port; and disconnecting the cylinder from the floating platform.

19. The method of claim 13, further comprising:

inputting fluid into the chamber on a first side of the piston assembly, wherein a shuttle is disposed within the flow path, and wherein an annular volume is located within the piston assembly and is in fluid communication with the chamber on a second side of the piston assembly;

maintaining the first port in an open position via the pilot, wherein a second port extends between the annular volume and the pilot;

forcing the shuttle to move via increasing pressure of the input fluid on the first side of the piston assembly to open a third port between the flow path and the annular volume; and circulating the input fluid through the chamber on the first side of the piston assembly, the flow path, and the annular volume to flush old fluid out of the annular volume while the first, second, and third ports are open.

20. The method of claim 19, further comprising circulating the input fluid through the chamber on the first side of the piston assembly, the flow path, and the annular volume while the distal end of the rod remains secured to the retention device.

21. The method of claim 19, wherein access to the first side of the piston assembly for inputting the fluid is available from a production deck proximate an upper end of the cylinder.

* * * * *